US006234494B1

(12) United States Patent
Gien

(10) Patent No.: US 6,234,494 B1
(45) Date of Patent: May 22, 2001

(54) BOOT SUPPORT ADJUSTING DEVICE

(76) Inventor: Yu Tze Gien, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 09/483,179

(22) Filed: Jan. 13, 2000

(51) Int. Cl.[7] ..... A63C 5/00
(52) U.S. Cl. ..... 280/14.24; 280/14.22; 280/607; 280/618; 280/613
(58) Field of Search ..... 280/14.21, 14.22, 280/14.24, 607, 618, 629, 613

(56) References Cited

U.S. PATENT DOCUMENTS 5,236,216 * 8/1993 Ratzek ..... 280/607
5,782,476 * 7/1998 Fardie ..... 280/14.2
5,791,678 * 9/1998 Perlman ..... 280/618
5,876,045 * 3/1999 Acuna, Jr. ..... 280/14.2
5,909,893 * 6/1999 Keller et al. ..... 280/607
5,947,488 * 9/1999 Gorza et al. ..... 280/14.2
6,007,085 * 12/1999 Rigal et al. ..... 280/607
6,022,041 * 2/2000 Dailey et al. ..... 280/618
6,065,768 * 5/2000 Lee ..... 280/613

* cited by examiner

*Primary Examiner*—J. J. Swann
*Assistant Examiner*—James S. McClellan

(57) ABSTRACT

A boot support includes a disc solidly secured on a ski board, and a boot supporting bracket rotatably secured to the disc. A pawl is slidably received in the disc and movable to engage with the bracket, or is slidably received in the bracket and movable to engage with the disc, for releasably securing the bracket to the ski board. The bracket may be adjusted relative to the disc and the ski board to various angular position by the pawl without disengaging the bracket from the disc and the ski board.

8 Claims, 3 Drawing Sheets

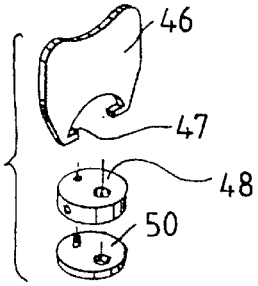
FIG. 4
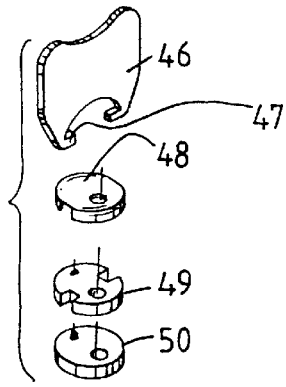
FIG. 3
FIG. 2
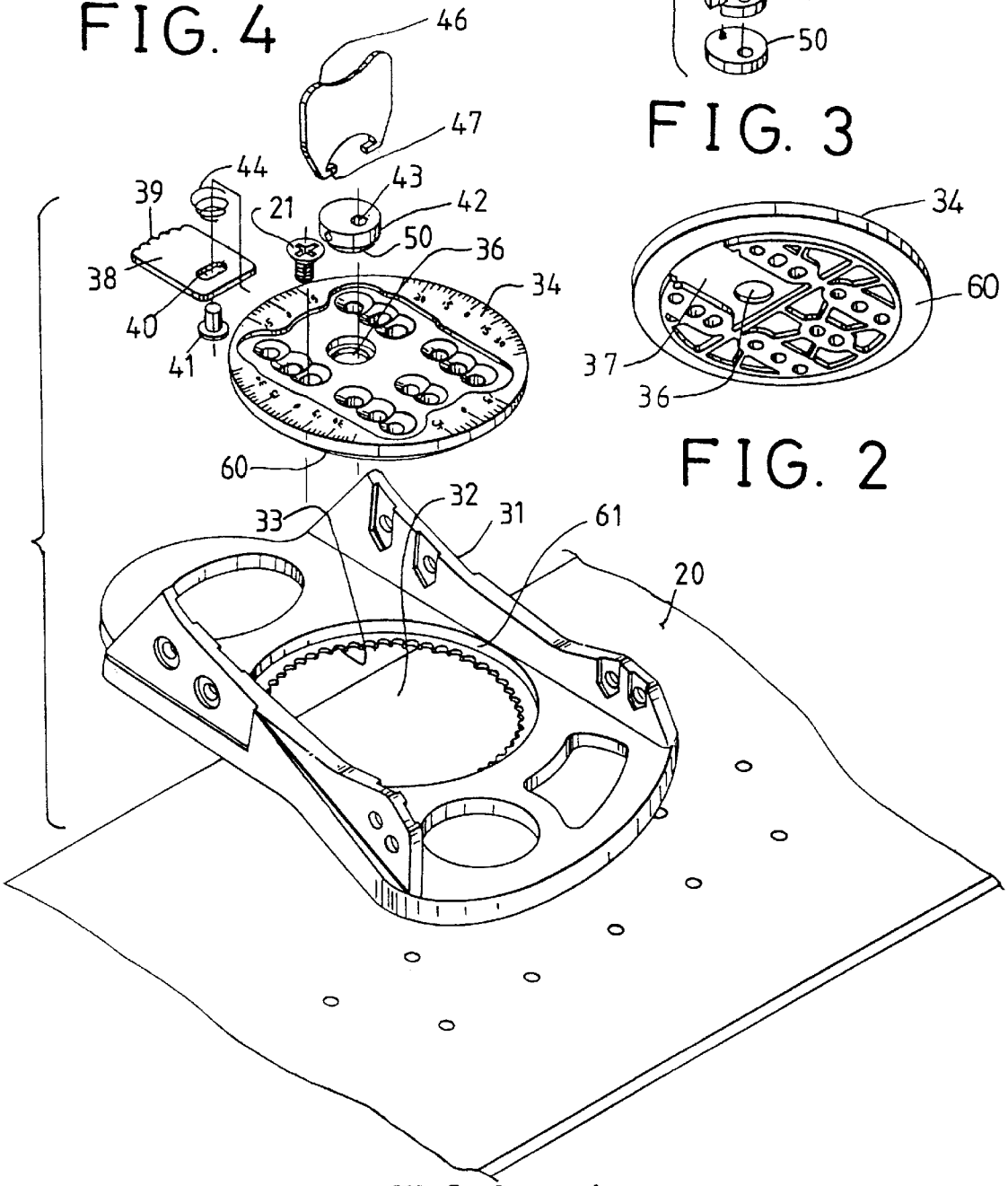
FIG. 1

BOOT SUPPORT ADJUSTING DEVICE

BACKGROUND OF THE INVENTION

1. Field of the Invention

The present invention relates to a boot support, and more particularly to a boot support having an angular adjusting device.

2. Description of the Prior Art

Typical boot supports comprise a bracket secured onto a ski board with fasteners for supporting a ski boot thereon. For adjusting the bracket and the ski boot relative to the ski board to the suitable angular position, the fasteners should all be disengaged from the bracket and should all be secured onto the bracket and the ski board again after the bracket has been adjusted relative to the ski board.

The present invention has arisen to mitigate and/or obviate the afore-described disadvantages of the conventional boot supports.

SUMMARY OF THE INVENTION

The primary objective of the present invention is to provide a boot support having a bracket easily adjustable relative to the ski board to various angular positions without disengaging the bracket from the ski board.

In accordance with one aspect of the invention, there is provided a boot support comprising a ski board, a disc disposed on the ski board, means for securing the disc to the ski board, a bracket for supporting ski boots including an opening formed therein for rotatably receiving the disc and for allowing the bracket to be rotated relative to the disc, and means for releasably securing the bracket to the disc.

The bracket includes an annular shoulder formed therein, the disc includes an annular shoulder formed therein and engaged with the annular shoulder of the bracket for rotatably securing the bracket to the disc.

The bracket includes a plurality of teeth formed therein, the releasably securing means includes a pawl slidably received in the disc, and means for actuating the pawl to engage with the teeth of the bracket. The disc includes a guide channel formed therein for slidably receiving the pawl.

The pawl actuating means includes an actuator rotatably received in the disc, and a pin engaged with the pawl and secured to the actuator at an off-center position and rotated by the actuator to move the pawl to engage with and to be disengaged from the teeth of the bracket. The pawl includes an oblong hole formed therein for slidably receiving the pin. The actuator includes a cover, and a base secured to the cover. The cover includes a block secured therein, the base is secured to the block.

A knob is further pivotally secured to the actuator at a pivot axle for rotating the actuator relative to the disc. A spring device is provided for biasing the pawl to engage with the ski board.

Further objectives and advantages of the present invention will become apparent from a careful reading of a detailed description provided hereinbelow, with appropriate reference to accompanying drawings.

BRIEF DESCRIPTION OF THE DRAWINGS

FIG. 1 is an exploded view of a boot support in accordance with the present invention;

FIG. 2 is a bottom perspective view of a disc;

FIG. 3 is an exploded view of an actuator;

FIG. 4 is an exploded view illustrating the other application of the actuator;

DETAILED DESCRIPTION OF THE PREFERRED EMBODIMENT

Figure 5:
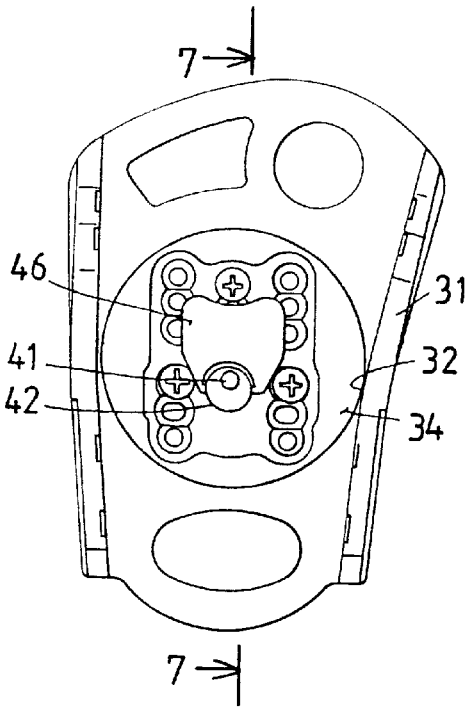
FIG. 5 is a top view of the boot support.

Referring to the drawings, and initially to FIGS. 1, 2 and 5–7, a boot support in accordance with the present invention comprises a disc 34 secured onto a ski board 20 with fasteners or the like and having an orifice 36 formed therein and having a peripheral or annular shoulder 60 formed in the bottom portion thereof and having a guide channel 37 formed in the bottom thereof (FIG. 2). A bracket 31 includes an opening 32 formed therein for rotatably receiving the disc 34 and includes a peripheral or annular shoulder 61 formed therein and engaged with the corresponding annular shoulder 60 of the disc 34 for rotatably securing the bracket 31 to the ski board 20 with the disc 34. The bracket 31 includes a number of teeth 33 formed therein and formed around the opening 32 and/or the annular shoulder 61 of the bracket 31. The boot support in accordance with the present invention is to provide a securing device for adjustably securing the bracket to the ski board to various angular positions without disengaging the bracket from the ski board, which will be described hereinafter.

Figure 7:
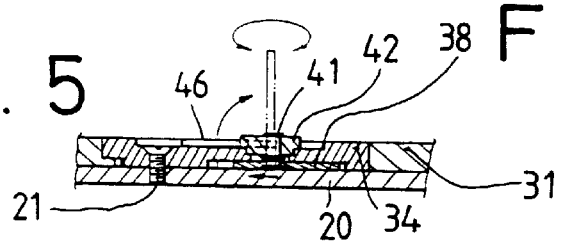
FIG. 7 is a cross sectional view taken along lines 7—7 of FIG. 5.
Figure 8:
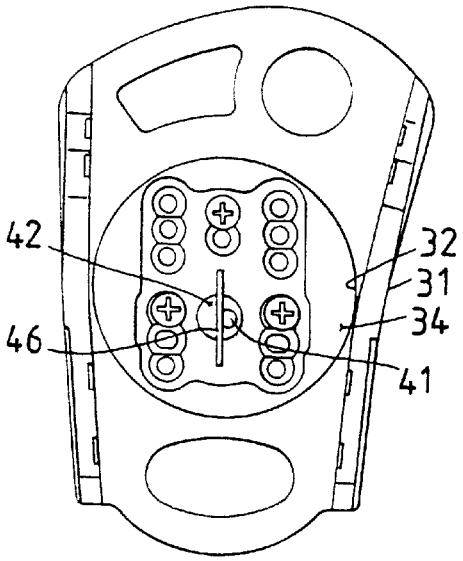
FIGS. 8 and 9 are a top view and a bottom view similar to FIGS. 5 and 6 respectively, illustrating the operation of the boot support.

A pawl 38 is slidably received in the guide channel 37 of the disc 34 and one or more teeth 39 formed thereon for engaging with the teeth 33 of the bracket 31, and includes an oblong hole 40 formed therein. An actuator 42 is rotatably received in the orifice 36 and includes an off-center hole 43 formed therein for receiving a pin 41 and for forming a cam actuating device. The pin 41 may be rotated by the actuator 42 and is slidably received in the oblong hole 40 of the pawl 38 such that the pawl 38 may be moved along the guide channel 37 of the disc 34 by the actuator 42 and will not move laterally relative to the disc 34 and such that the teeth 39 of the pawl 38 may be forced to engage with the teeth 33 of the bracket 31. A hand grip or a knob 46 is pivotally secured to the actuator 42 with one or more hooks 47 which form the pivot axle of the knob 46 to the actuator 42, for allowing the knob 46 to be rotated relative to the actuator 42 to engage with or to be disengaged from the disc 34 (FIGS. 5, 7, 8). A spring 44 is engaged on the pin 41 and engaged between the disc 34 and the pawl 38 for biasing the pawl 38 to engage with the ski board 20 and for allowing the teeth 39 of the pawl 38 to be forced to solidly engage with the teeth 33 of the bracket 31.

Referring next to FIG. 3, the actuator 42 includes a block 49 received in a cover 48, and a base 50 secured to the block 49 with fasteners, for example. Alternatively, referring next to FIG. 4, the block 49 may be received in the cover 48 and may be formed as an integral one piece with the cover 48. The base 50 has a size smaller than that of the block 49 such that a peripheral or annular shoulder may be formed between the base 50 and the block 49 or may be formed in the bottom portion of the actuator 42 for rotatably engaging with a corresponding peripheral or annular shoulder formed in the disc 31.

Figure 6:
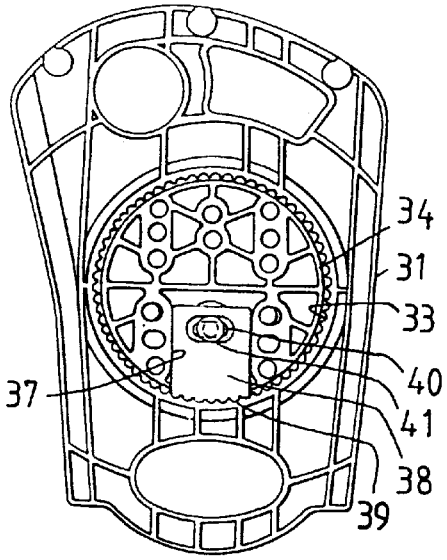
FIG. 6 is a bottom view of the boot support, in which the ski board has been removed.
Figure 9:
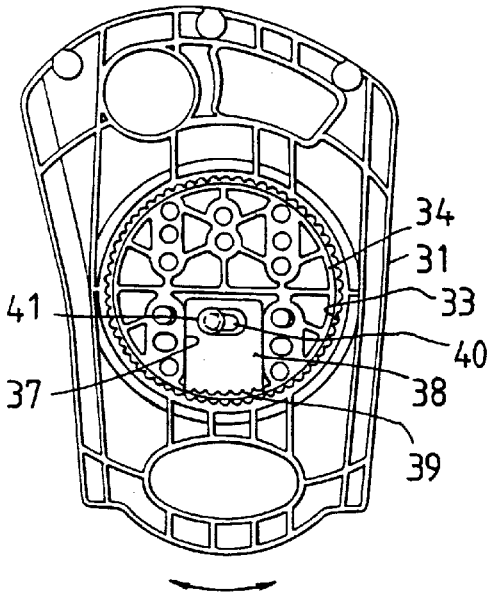

In operation, as shown in FIGS. 5 and 6, the pawl 38 may be caused to engage with the teeth 33 of the bracket 31 by the actuator 42 with the knob 46. As shown in FIGS. 7–9, when the knob 46 is rotated relative to the actuator 42 to an erect position perpendicular to the actuator 42 as shown in dotted lines in FIG. 7, the actuator 42 and thus the pin 41 may be rotated by the knob 46 to move the pawl 38 along the guide channel 37 of the disc 34 and to engage or to disengage the teeth 39 of the pawl 38 from the teeth 33 of the bracket 31. The bracket 31 may be rotated relative to the disc 34 when the pawl 38 is disengaged or released from the bracket 31. The pawl 38 may be caused to engage with the bracket 31 again in order to lock the bracket 31 to the disc 34 again when the bracket 31 and thus the ski boot supported thereon are adjusted relative to the ski board 20 and the disc 34 to the required angular position. The disc 34 and/or the fasteners 21 are not required to be disengaged from the ski board 20.

Figure 10:
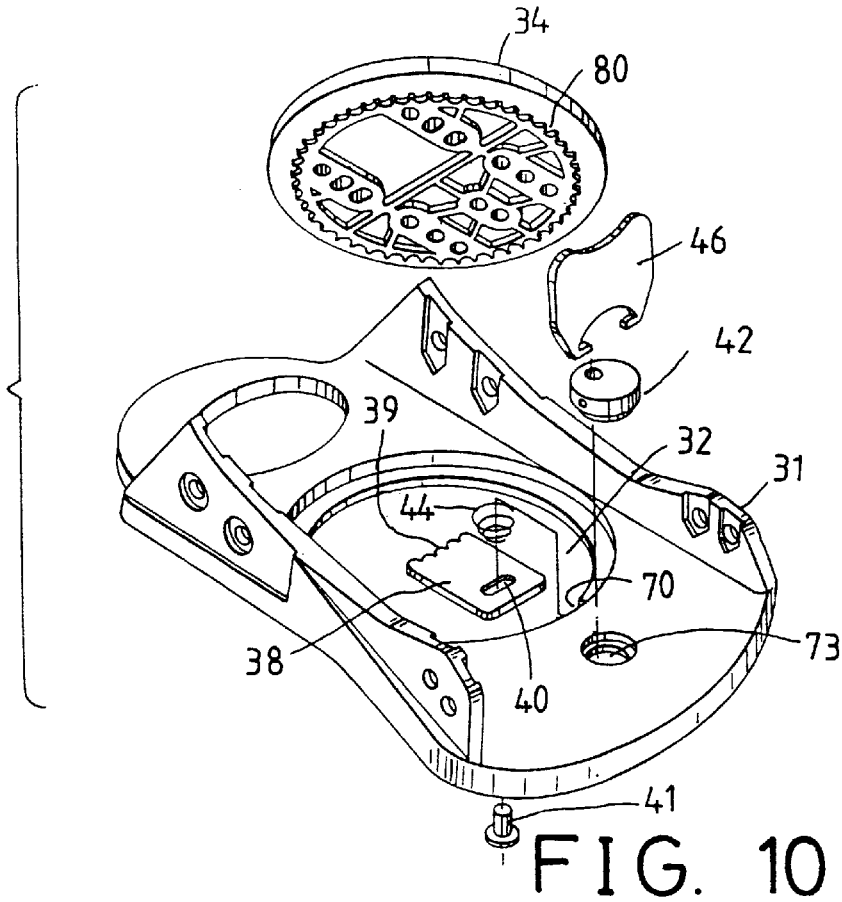
FIG. 10 is an exploded view illustrating the other application of the boot support.
Figure 11:
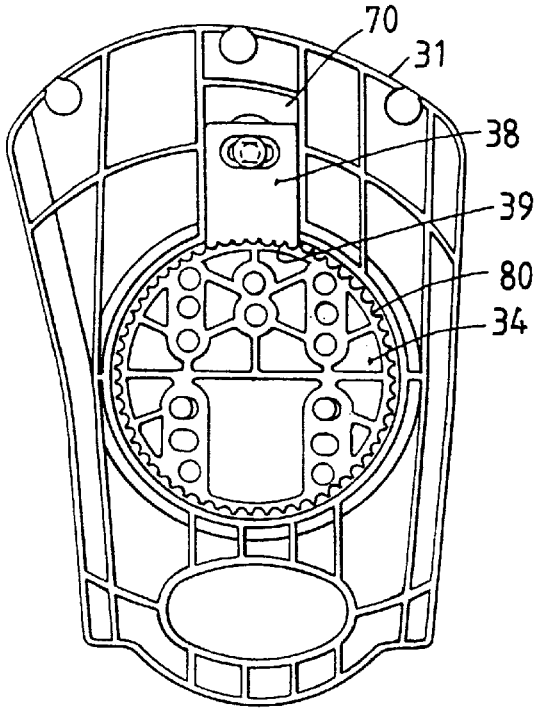
FIG. 11 is a bottom view of the boot support as shown in FIG. 10.

Referring next to FIGS. 10 and 11, alternatively, the disc 34 may include a number of teeth 80 formed therein, and the bracket 31 may include an aperture 73 formed therein for rotatably receiving the actuator 42 and may include a guide channel 70 formed therein for slidably receiving the pawl 38 which may be forced to engage with or to be disengaged from the teeth 80 of the disc 34 by the actuator 42, such that the bracket may also be easily adjusted relative to the ski board to various angular positions without disengaging the bracket from the ski board.

Accordingly, the boot support in accordance with the present invention includes a bracket easily adjustable relative to the ski board to various angular positions without disengaging the bracket from the ski board.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A boot support comprising:

a ski board, a disc disposed on said ski board, means for securing said disc to said ski board, a bracket for supporting ski boots including an opening formed therein for rotatably receiving said disc and for allowing said bracket to be rotated relative to said disc, said bracket including a plurality of teeth formed therein, and means for releasably securing said bracket to said disc, said releasably securing means including a pawl slidably received in said disc, and means for actuating said pawl to engage with said teeth of said bracket, said pawl actuating means including an actuator rotatably received in said disc, and a pin engaged with said pawl and secured to said actuator at an off-center position and rotated by said actuator to move said pawl to engage with and to be disengaged from said teeth of said bracket.

2. The boot support according to claim 1, wherein said bracket includes an annular shoulder formed therein, said disc includes an annular shoulder formed therein and engaged with said annular shoulder of said bracket for rotatably securing said bracket to said disc.

3. The boot support according to claim 1, wherein said bracket includes a guide channel formed therein for slidably receiving said pawl.

4. The boot support according to claim 1, wherein said pawl includes an oblong hole formed therein for slidably receiving said pin.

5. The boot support according to claim 1, wherein said actuator includes a cover, and a base secured to said cover.

6. The boot support according to claim 5, wherein said cover includes a block secured therein, said base is secured to said block.

7. The boot support according to claim 1 further comprising a knob pivotally secured to said actuator at a pivot axle for rotating said actuator relative to said disc.

8. The boot support according to claim 1 further comprising means for biasing said pawl to engage with said ski board.

* * * * *